US005673603A

United States Patent [19]

Aichele

[11] Patent Number: 5,673,603

[45] Date of Patent: Oct. 7, 1997

[54] DEVICE FOR CUTTING ADVANCING MATERIAL WEBS TO SHAPE

[76] Inventor: Wilhelm Aichele, Mozartstrasse 12,, 74564 Crailsheim, Germany

[21] Appl. No.: 739,731

[22] Filed: Nov. 7, 1996

Related U.S. Application Data

[63] Continuation of Ser. No. 362,545, Jan. 4, 1995, abandoned.

[30] Foreign Application Priority Data

Jul. 14, 1992 [DE] Germany ..... 42 23 050.0

[51] Int. Cl.[6] ..... B26D 7/26; B26D 1/62

[52] U.S. Cl. ..... 83/344; 83/346; 72/240; 100/168

[58] Field of Search ..... 83/343–349, 503, 83/673; 72/240; 100/168

[56] References Cited

U.S. PATENT DOCUMENTS

| | | | |
|---|---|---|---|
| 3,186,275 | 6/1965 | Obenshain | 83/349 X |
| 3,448,684 | 6/1969 | Cardinet et al. | 83/344 X |
| 3,570,348 | 3/1971 | Hallden | 83/344 X |
| 4,205,596 | 6/1980 | Chesnut | 83/344 X |
| 4,359,919 | 11/1982 | Fuchs et al. | 83/344 X |
| 5,001,950 | 3/1991 | Fokos et al. | 83/344 X |
| 5,156,076 | 10/1992 | Rosemann | 83/344 |
| 5,174,185 | 12/1992 | Aichele | 83/348 X |

FOREIGN PATENT DOCUMENTS

| | | |
|---|---|---|
| 421171 | 4/1937 | Belgium . |
| 7831892 | 10/1978 | Germany . |

*Primary Examiner*—Rinaldi I. Rada
*Assistant Examiner*—Clark F. Dexter
*Attorney, Agent, or Firm*—Shenier & O'Connor

[57] ABSTRACT

A device for cutting to shape advancing material webs, in particular made of fibrous materials, comprises a rotatingly driven shape cutting roller and a rotatingly driven counter cutting roller. The shape cutting roller has a shape cutting edge and the counter cutting roller a smooth cylinder surface. Both rollers are mounted in a machine frame by means of pivot bearings, and the distance between the axes of the rollers is adjustable. The rollers are rotatably mounted in separate, first and second machine frame parts which, for their part, are supported on a common machine base. One of these machine frame parts is held on an adjustable wedge-shaped guide means for adjusting the distance between the axes of the rollers. Each machine frame part is adapted to be secured separately on the machine base.

6 Claims, 3 Drawing Sheets

DEVICE FOR CUTTING ADVANCING MATERIAL WEBS TO SHAPE

This application is a continuation of application Ser. No. 08/362,545 filed on Jan. 4, 1995, now abandoned.

The invention relates to a device for cutting to shape advancing material webs, in particular made of fibrous materials, comprising a rotatingly driven shape cutting roller and a rotatingly driven counter cutting roller, whereby the shape cutting roller has a shape cutting edge and the counter cutting roller a smooth cylinder surface, both rollers are mounted in a machine frame on both sides by means of pivot bearings and the distance between the axes of the rollers is adjustable.

Devices of this type are known, for example, from DE-OS 39 24 053. With such devices it is possible to cut advancing material webs made of fibrous material, e.g. in the form of paper, fiber fleece, textiles but also plastic or metal foils and the like, whereby complete, curve-like cut edges can be produced. Devices of this type are used, in particular, for the production of baby pants, sanitary napkins and ladies' panty liners made of non-woven fabric or fleece. The shape cutting edge arranged on the shape cutting roller is pressed during the cutting process onto the smooth cylinder surface of the counter cutting roller while the material web passes through between the two rollers. This leads to point contacts of the shape cutting edge with the counter cutting roller and due to the contact pressure, with which the shaping edge is pressed onto the smooth cylinder surface of the counter cutting roller, to the breaking off of parts of the shape cutting edge and, finally, to a short service life of the device.

The object of the invention is to provide a device which eliminates the specified disadvantages by preventing parts of the shape cutting edge from being broken off in order to thereby make a longer service life of the entire device possible.

The object is accomplished in a generic device for cutting advancing material webs to shape in that the rollers are rotatably mounted in separate, first and second machine frame parts which, for their part, are supported on a common machine base part, that one of these machine frame parts is held on an adjustable wedge-shaped guide means for adjusting the distance between the axes of the rollers and that each machine frame part is adapted to be tensioned or secured separately on the machine base part.

Due to this arrangement it is possible for the distance between the axes of the rollers to be adjusted very exactly and therefore the contact pressure, with which the shape cutting roller is pressed onto the counter cutting roller, as well. In the extreme case, it is even possible to cut without contact pressure.

The following description of a preferred embodiment serves to explain this in greater detail in conjunction with the attached drawings. In the drawings.

Figure 1:
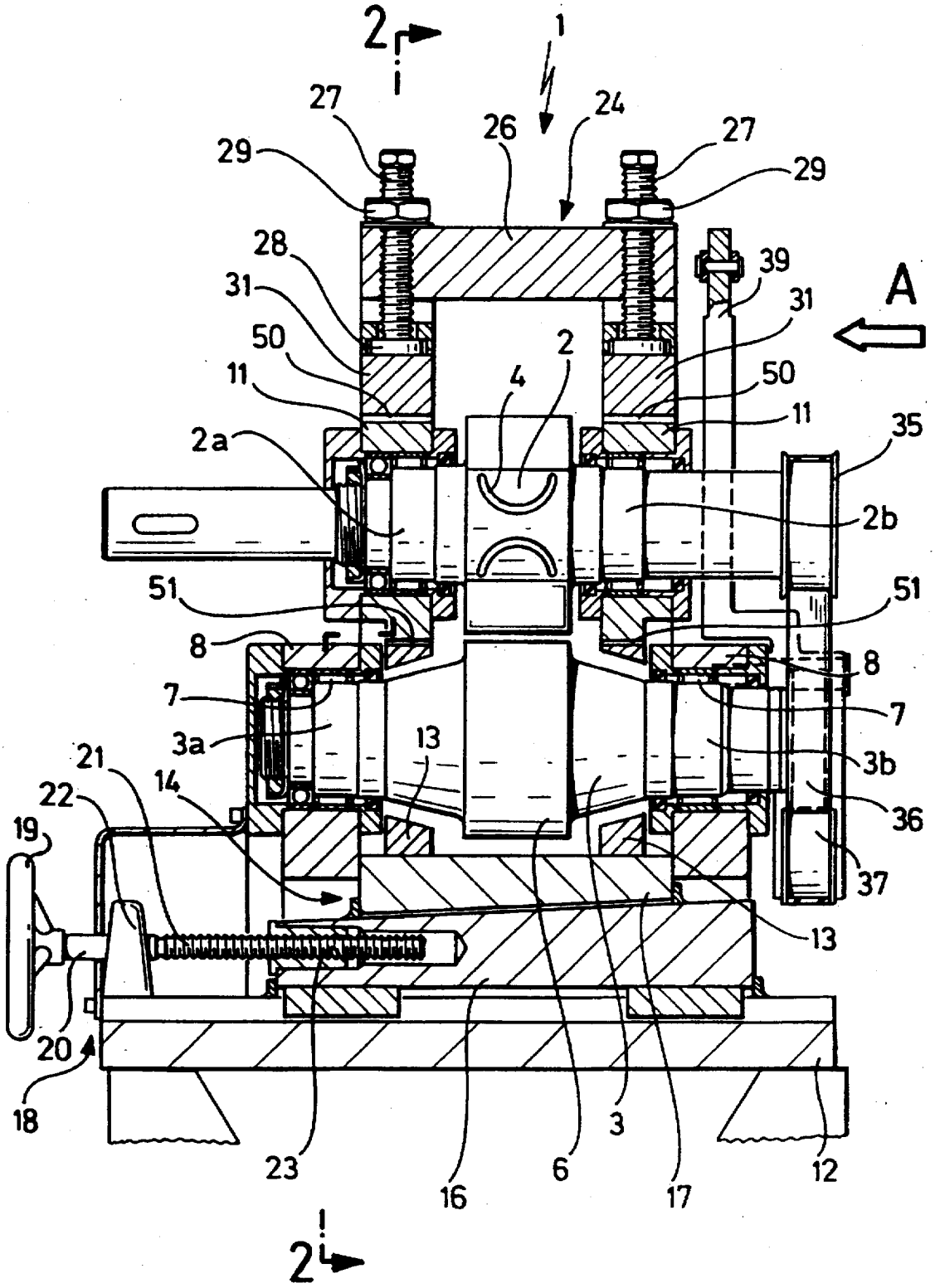
FIG. 1 shows a sectional front view of a device for cutting advancing material webs to shape.

As shown in FIG. 1, a preferred embodiment of a device 1 for cutting to shape advancing material webs made from fibrous materials comprises a rotatingly driven shape cutting roller 2 and a contrarotatingly driven counter cutting roller 3 which is arranged with its axis parallel to the axis of the shape cutting roller 2. In order to avoid lateral vibrations, the shape cutting roller 2 is designed as a solid, compact shaft having a central region, on which a protruding shape cutting edge 4 is formed, and shaft sections 2*a* and 2*b* arranged on either side of the shape cutting roller 4. The central region of the cylinder surface has a larger diameter than the shaft sections 2*a* and 2*b*. The shape cutting edge 4 can be curve-shaped and form a complete edge all round. Opposite the shape cutting edge 4 the counter cutting roller, which is also designed as a solid shaft, has a smooth, for example, polished cylinder surface 6. The diameter of the cylinder surface 6 is greater than the diameter of the shaft sections 3*a* and 3*b* adjoining the cylinder surface 6 on both sides. In order to design the counter cutting roller 3 to be as stable as possible to avoid vibrations, the counter cutting roller 3 is of a conical design on both sides of the cylinder surface 6, whereby the diameter of the shaft constantly decreases from the value of the cylinder surface 6, with increasing distance from the cylinder surface 6, until it finally has the value of the diameter of the two shaft sections 3*a*, 3*b*. The shaft sections 3*a*, 3*b* of the counter cutting roller are each supported in pivot bearings 7 at as small a distance from the cylinder surface 6 as possible, these pivot bearings being secured in a first machine frame part 8. The shape cutting roller is supported in pivot bearings 9 by means of its shaft sections 2*a*, 2*b*, these pivot bearings each being arranged as closely adjacent to the shape cutting edge 4 as possible in a second machine frame part 11.

Figure 2:
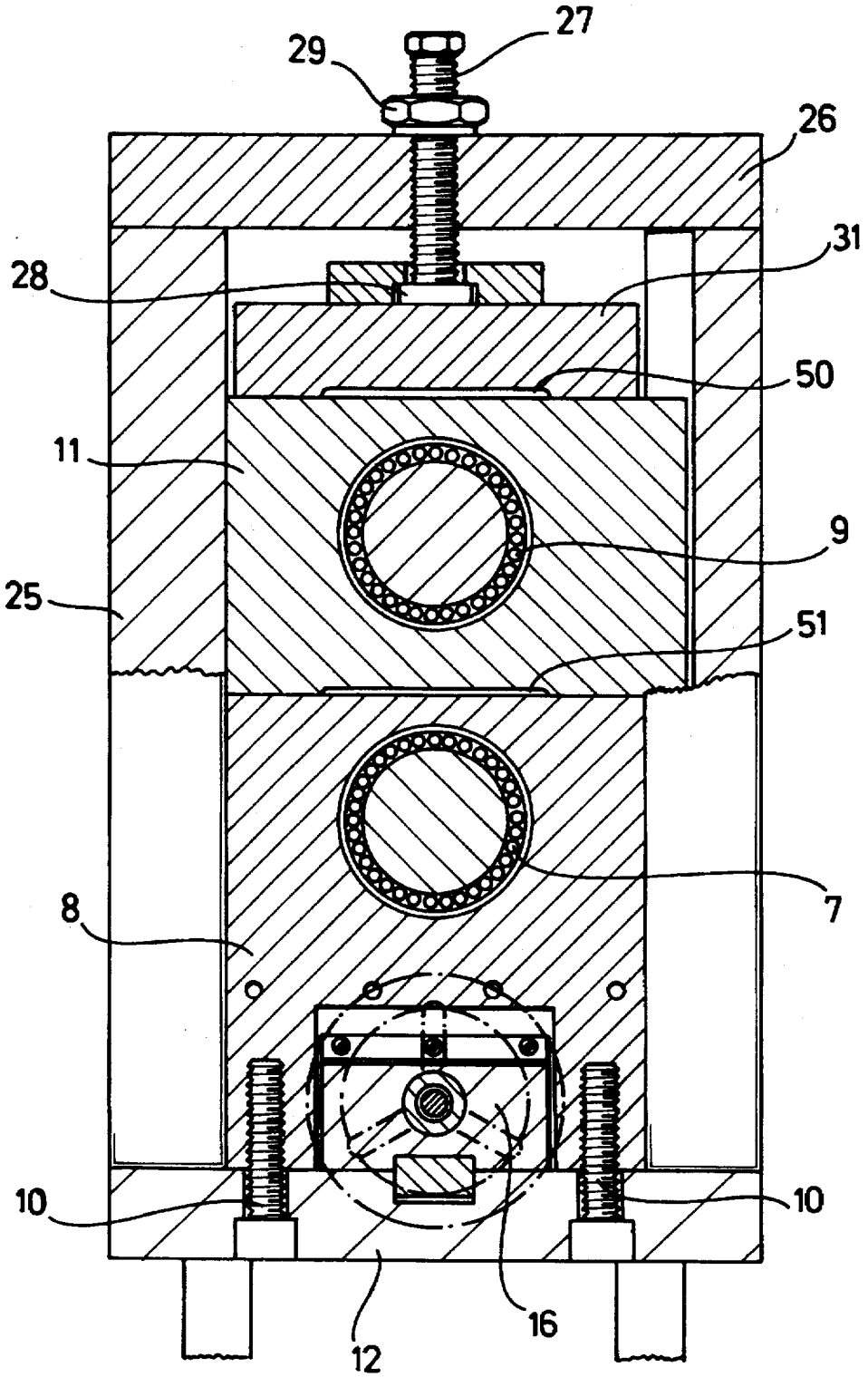
FIG. 2 shows a sectional side view of the device along line 2—2 of FIG. 1.

As shown, in particular, in FIGS. 1 and 2, the pivot bearings 7 and 9 have a diameter which corresponds more or less to the diameter of the counter cutting roller 3 or of the shape cutting roller 2. This facilitates a secure mounting of the shape cutting roller 2 and the counter cutting roller 3 and an avoidance of vibrations.

The pivot bearings 7 and 9 are controllably coolable by means of a cooling means known per se, which is not illustrated, so as to avoid any heat expansion of the pivot bearings 7 and 9 as well as any heat expansion of the cutting rollers 2, 3 and, connected therewith, any disruptive change in position of the shape cutting edge 4 of the shape cutting roller 2 in relation to the cylinder surface 6 of the counter cutting roller 3 during the operation of the device 1. Moreover, the rollers 2, 3 themselves can also be controllably cooled by the cooling means for the same purpose.

The first machine frame part 8 is designed in the shape of a bridge and firmly secured or clamped on a machine base part 12. This securing can be adjusted by screws 10 (FIG. 2) which protrude from below through the machine base part 12 and engage in a thread arranged in the first machine frame part 8. The second machine frame part 11 is supported on a bridge 13 which spans or encloses the counter cutting roller 3 and, for its part, displaceably rests on a wedge-shaped guide means 14. The wedge-shaped guide means 14 is supported on the machine base part 12. In the present embodiment, the bridge 13 consists of two parts—optionally connected with one another —, of which each part encloses a respective shaft section 3*a*, 3*b* of the counter cutting roller 3 with clearance.

The wedge-shaped guide means 14 comprises a first wedge-shaped part 16 which is displaceable horizontally on the machine base part 12 and a second wedge-shaped part 17 which rests with its inclined surface on the inclined surface of the first wedge-shaped part 16. The bridge 13 rests on an essentially horizontal surface of the wedge-shaped part 17 located opposite the inclined surface.

The first wedge-shaped part 16 is provided with an adjusting means 18. The adjusting means 18 comprises a handwheel 19 which is secured to one end of a shaft 20. A thread 21 is provided on the shaft 20 at its other end facing the wedge-shaped guide means 14. The shaft 20 is held so as to be rotatable in a holder 22 which, for its part, is secured to the machine base part 12.

A tapped bore 23 is arranged in the first wedge-shaped part 16 on the side facing the adjusting means 18. This tapped bore matches the thread 21 of the shaft 20. By turning the handwheel 19, the thread 21 is screwed into or out of the tapped bore 23. Since the handwheel 19, the shaft and the thread 21 are held stationarily and non-displaceably on the machine base part 12, the first wedge-shaped part 16 is, on the other hand, displaceable horizontally on the machine base part 12, the wedge-shaped part 16 of the wedge-shaped guide means 14 is moved horizontally on the machine base frame 12 when the handwheel 19 is turned—to the left or to the right in FIG. 1. At the same time, the inclined, surface of the first wedge-shaped part 16 slides along the inclined surface of the second wedge-shaped part 17, whereby the second wedge-shaped part 17 is displaced within the first machine frame part 8 vertically, i.e. upwards or downwards.

The bridge 13 resting on the second wedge-shaped part 17 is also displaced with this part and the second machine frame part 11 securely arranged on the bridge 13. This means that the distance of the axis of the shape cutting roller 2 in relation to the stationary axis of the counter cutting roller 3 can be adjusted very exactly.

Furthermore, in order to avoid elastic deflections and therefore vibrations of the two rollers 2, 3, which considerably impair the quality of the cut, a clamping means 24 is provided. The clamping means 24 comprises a crossbar 26 connected with the machine base part 12 via uprights 25 (FIG. 2). Tapped bores in the crossbar 26 accommodate two screws 27 which are aligned with the pivot bearings 9 in the machine frame part 11. The screws 27 have at their lower end circular disk-shaped flanges 28; they are secured against any self-release by check nuts 29. The circular disk-shaped flanges 28 of the screws 27 press on clamping bars 31 which, for their part, again rest on the second machine frame part 11. By turning the screws 27, their circular disk-shaped flanges 28 press onto the clamping bars 31 and these onto the second machine frame part 11, which brings about a precise, adjustable securing of the second machine frame part 11 on the wedge-shaped guide means 14 and, hence, on the machine base part 12.

In order to divert the pressure exerted by the clamping means 24 on the clamping bars 31, the second machine frame part 11 and the bridge 13 not only around the pivot bearings 9 in the second machine frame part but also around conical bores in the bridge 13, through which the counter cutting roller 3, which is of a conical design on both sides of its cylinder surface 6, is guided, gaps 50 and 51 are arranged in the clamping bars 31 and in the second machine frame part 11 to align with the pivot bearings 9 in the machine frame part 11 and with the bores in the bridge 13, respectively. The gaps 50 and 51 allow an elastic deflection of the clamping bars 31 and the second machine frame part 11, respectively, and thereby prevent the direct transfer of the pressure to the pivot bearings and the bores.

Instead of the clamping device 24 as described, a hydraulic clamping device which is known per se can, for example, also be used.

Figure 3:
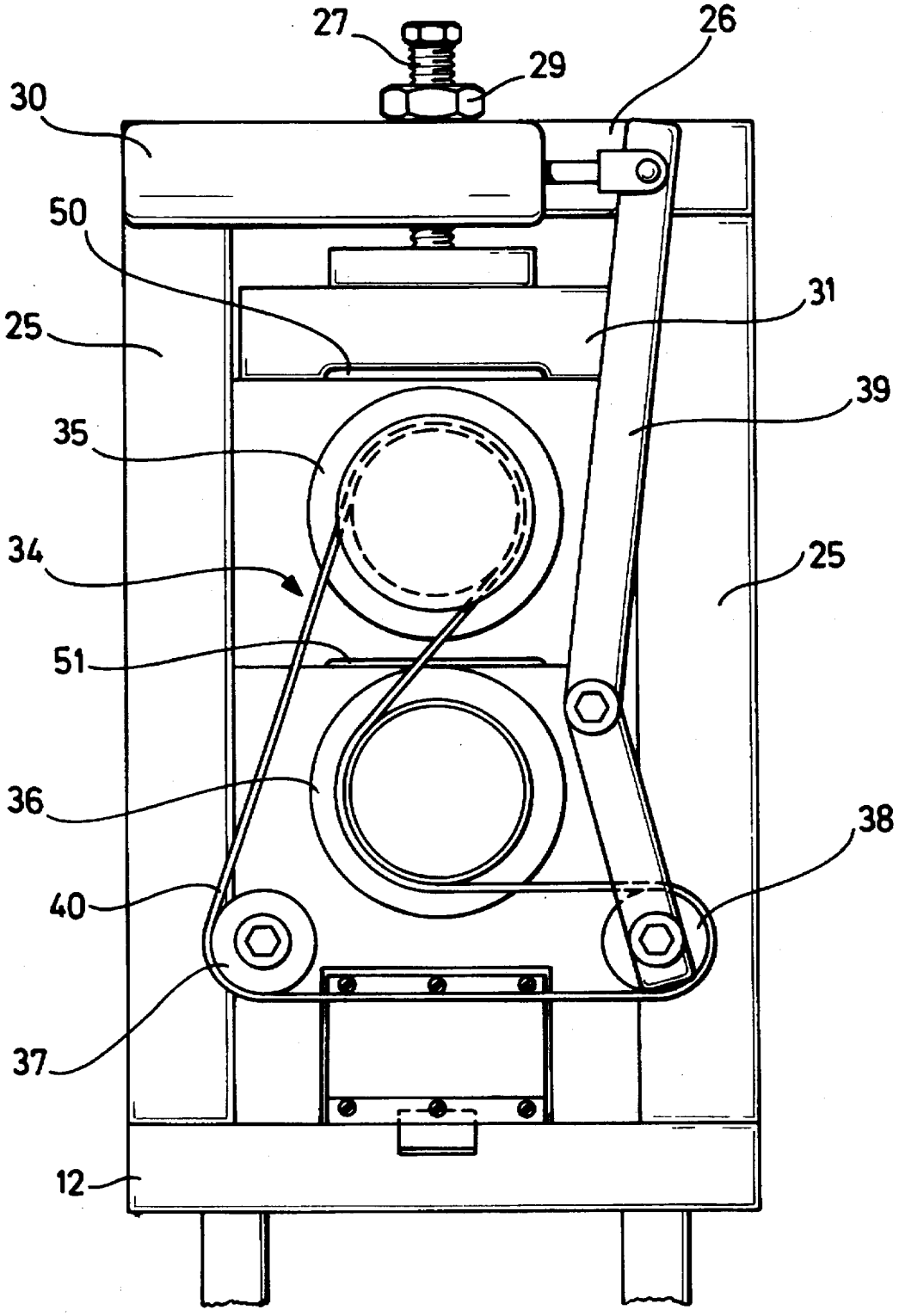
FIG. 3 shows a side view in the direction of arrow A of FIG. 1.

As is apparent, in particular, from FIG. 3, the rollers 2, 3 are driven by a belt drive 34. The belt drive 34 essentially comprises a belt pulley 35 connected to the shape cutting roller 2, a belt pulley 36 connected to the counter cutting roller, a deflector roller 37 and a tension roller 38, which is mounted on a pivotable lever 39 for adjusting the tension of the drive belt 40. The lever 39 is adjusted by means of a double-acting piston-cylinder unit 30.

The drive belt 40 is guided over the belt pulley 35, the belt pulley 36, the deflector roller 37 and the tension roller 38 such that the counter cutting roller 3 rotates in the opposite direction in relation to the shape cutting roller 2. In addition, the drive is designed by corresponding dimensioning of the diameters of the pulleys 35, 36 such that the counter cutting roller 3 is driven asynchronously to the shape cutting roller 2 so that the rotational speed of the counter cutting roller 3 is slightly less than that of the shape cutting roller 2. In this way, it is possible to achieve a uniform wear and tear on the sensitive, mostly polished, smooth cylinder surface of the counter cutting roller 3 and thereby increase its service life.

I claim:

1. A device for cutting a web including in combination a machine base, a first machine frame mounted on the machine base, a counter roller having an axis and a smooth cylindrically surfaced portion and axially extending shaft portions on either side of the cylindrically surfaced portion, means mounting the counter roller for rotation on the first machine frame, a second machine frame, a cutting roller having an axis, means mounting the cutting roller for rotation on the second machine frame with the cutting roller axis parallel to the counter roller axis, a first wedge having a first surface parallel to the axes of the rollers and a second surface inclined thereto, adjusting means including a second wedge movably mounted on the machine base for moving the first wedge along a first axis orthogonal to the axis of the counter roller, and a pair of spaced bridge members having apertures through which the respective axially extending shaft portions of the counter roller extend with clearances affording relative motion therebetween along the first axis, the bridge members being mounted on the first surface and contacting the second machine frame, movement of the first wedge producing concomitant movement of both bridge members and the second machine frame along the first axis.

2. A device as in claim 1, wherein the second wedge moves orthogonally to the first axis.

3. A device as in claim 1 further including means mounted on the machine base for applying clamping forces to the second machine frame.

4. A device as in claim 1 wherein the second machine frame is supported by the two spaced bridge members.

5. A device as in claim 1, wherein the counter roller is disposed between the cutting roller and the first wedge.

6. A device as in claim 1, wherein the first wedge synchronously moves both bridge members, and the cutting roller axis is maintained parallel to the counter roller axis.

* * * * *

UNITED STATES PATENT AND TRADEMARK OFFICE

CERTIFICATE OF CORRECTION

PATENT NO. : 5,673,603
DATED : October 7, 1997
INVENTOR(S) : Wilhelm Aichele

It is certified that error appears in the above-identified patent and that said Letters Patent is hereby corrected as shown below:

Title Page:

Under "Related U.S. Application Data", after "abandoned" insert -- , which is a 371 of PCT/EP93/01681, June 30, 1993 --.

Signed and Sealed this

Seventeenth Day of February, 1998

*Attest:*

*Attesting Officer*

Bruce Lehman

BRUCE LEHMAN

*Commissioner of Patents and Trademarks*